US009773489B2

(12) United States Patent
Yano

(10) Patent No.: US 9,773,489 B2
(45) Date of Patent: Sep. 26, 2017

(54) ACTIVE VIBRATION NOISE CONTROL APPARATUS

(71) Applicant: Atsuyoshi Yano, Chiyoda-ku (JP)

(72) Inventor: Atsuyoshi Yano, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 205 days.

(21) Appl. No.: 14/434,150

(22) PCT Filed: Nov. 5, 2012

(86) PCT No.: PCT/JP2012/007059
§ 371 (c)(1),
(2) Date: Apr. 8, 2015

(87) PCT Pub. No.: WO2014/068624
PCT Pub. Date: May 8, 2014

(65) Prior Publication Data

US 2015/0269924 A1 Sep. 24, 2015

(51) Int. Cl.
*G10K 11/178* (2006.01)

(52) U.S. Cl.
CPC .... *G10K 11/178* (2013.01); *G10K 2210/1282* (2013.01); *G10K 2210/3028* (2013.01)

(58) Field of Classification Search
CPC ..... G10K 11/178; G10K 2210/1282; G10K 2210/3028
USPC ..... 381/71.1, 71.2, 71.12
See application file for complete search history.

(56) References Cited

U.S. PATENT DOCUMENTS

| | | | | |
|---|---|---|---|---|
| 8,254,589 | B2 | 8/2012 | Mitsuhata | |
| 2008/0118083 | A1* | 5/2008 | Mitsuhata | G10K 11/178 381/94.3 |

FOREIGN PATENT DOCUMENTS

| | | | |
|---|---|---|---|
| CN | 1573918 | A | 2/2005 |
| CN | 101176145 | A | 5/2008 |
| CN | 102046424 | A | 5/2011 |
| CN | 102292241 | A | 12/2011 |
| EP | 1 884 920 | A1 | 2/2008 |
| JP | 4 334162 | | 11/1992 |
| JP | 5-33625 | A | 2/1993 |

(Continued)

OTHER PUBLICATIONS

Office Action issued Oct. 6, 2015 in Japanese Patent Application No. 2014-544058 (with English language translation).

(Continued)

*Primary Examiner* — Vivian Chin
*Assistant Examiner* — Douglas Suthers
(74) *Attorney, Agent, or Firm* — Oblon, McClelland, Maier & Neustadt, L.L.P.

(57) ABSTRACT

A first control signal filter to which a cosine wave oscillating at a control frequency is input; a second control signal filter to which a sine wave oscillating at the control frequency is input; a control signal adder for outputting a control signal generated by adding an output of the first control signal filter and an output of the second control signal filter; a filter coefficient update unit for updating filter coefficients of the first control signal filter and the second control signal filter; and a frequency correction value calculation unit for calculating a frequency correction value for correcting the control frequency on the basis of the control signal and the control frequency.

18 Claims, 5 Drawing Sheets

(56) References Cited

FOREIGN PATENT DOCUMENTS

| | | | |
|---|---|---|---|
| JP | 5 332395 | | 12/1993 |
| JP | 7 84585 | | 3/1995 |
| JP | 7 210173 | | 8/1995 |
| JP | 8-95580 | A | 4/1996 |
| JP | 2000 99037 | | 4/2000 |
| JP | 2002 207532 | | 7/2002 |
| JP | 2006 308809 | | 11/2006 |
| JP | 2009 255664 | | 11/2009 |
| JP | 2009-298253 | A | 12/2009 |
| JP | 2010-12813 | A | 1/2010 |
| JP | 2010 167844 | | 8/2010 |
| JP | 2011 112168 | | 6/2011 |

OTHER PUBLICATIONS

Combined Office Action and Search Report issued Dec. 28, 2016 in Chinese Patent Application No. 201280076798.7 (with English translation of Office Action and English translation of categories of cited documents).

International Search Report Issued Jan. 22, 2013 in PCT/JP12/007059 Filed Nov. 5, 2012.

* cited by examiner

ACTIVE VIBRATION NOISE CONTROL APPARATUS

TECHNICAL FIELD

The invention relates to an active vibration noise control apparatus which reduces vibration noise by generating a control signal on the basis of a control frequency determined in accordance with a rotational period of rotating equipment.

BACKGROUND ART

As an apparatus for reducing vibration noise originated by rotating equipment such as a vehicle engine, an active vibration noise control apparatus using an adaptive notch filter is known. In such a conventional active vibration noise control apparatus, a control frequency is set to a vibration noise frequency identified by the rotational period of rotating equipment, and a control signal having an opposite phase of the vibration noise and having the control frequency is generated, and is output as a secondary vibration noise that is to be interfered with the vibration noise, so that the vibration noise is reduced.

Here, in a case where a frequency mismatch between an actual vibration noise frequency and the control frequency occurs owing to a measurement error and a signal delay, etc., of a rotation period sensor of rotating equipment, a problem arises in that a reduction effect on the vibration noise is weakened.

For addressing such a problem, for example, in Patent Document 1, a method is disclosed in which the control frequency is corrected in accordance with coefficient behavior of the adaptive notch filter.

PRIOR ART DOCUMENT

Patent Document

Patent Document 1: Japanese Unexamined Patent Publication No. 2010-167844

SUMMARY OF THE INVENTION

Problems to be Solved by the Invention

However, in the method described in Patent Document 1, the control frequency is corrected on the basis of a change in the argument when a filter coefficient of the adaptive notch filter is projected on the complex plane, and thus there has been a problem in that the computational processing load for the argument is high when real-time processing is carried out.

The present invention has been made to overcome the above-described problem, and a purpose thereof is to provide an active vibration noise control apparatus that reduces vibration noise steadily by correcting by itself the mismatch of the control frequency with a low computational processing load.

Means for Solving the Problems

An active vibration noise control apparatus according to the present invention includes: a first control signal filter to which a cosine wave oscillating at a control frequency specified in accordance with a vibration noise source is input, the vibration noise source generating a vibration noise; a second control signal filter to which a sine wave oscillating at the control frequency is input; a control signal adder outputting a control signal generated by adding an output of the first control signal filter and an output of the second control signal filter; a filter coefficient updater updating coefficients of the first control signal filter and the second control signal filter on the basis of an error signal, the cosine wave signal, and the sine wave signal, the error signal being obtained from an interference result of the vibration noise with a secondary vibration noise generated on the basis of the control signal; and a frequency correction value calculator calculating a frequency correction value used for correcting a mismatch between the vibration noise frequency and the control frequency on the basis of the control signal.

Effect of the Invention

According to the active vibration noise control apparatus of the present invention, a frequency correction value of the control frequency is determined on the basis of the control signal, so that the mismatch between the control frequency and the actual vibration noise frequency can be reduced with a low computational processing load.

EMBODIMENT FOR CARRYING OUT THE INVENTION

Embodiment 1

Figure 1:
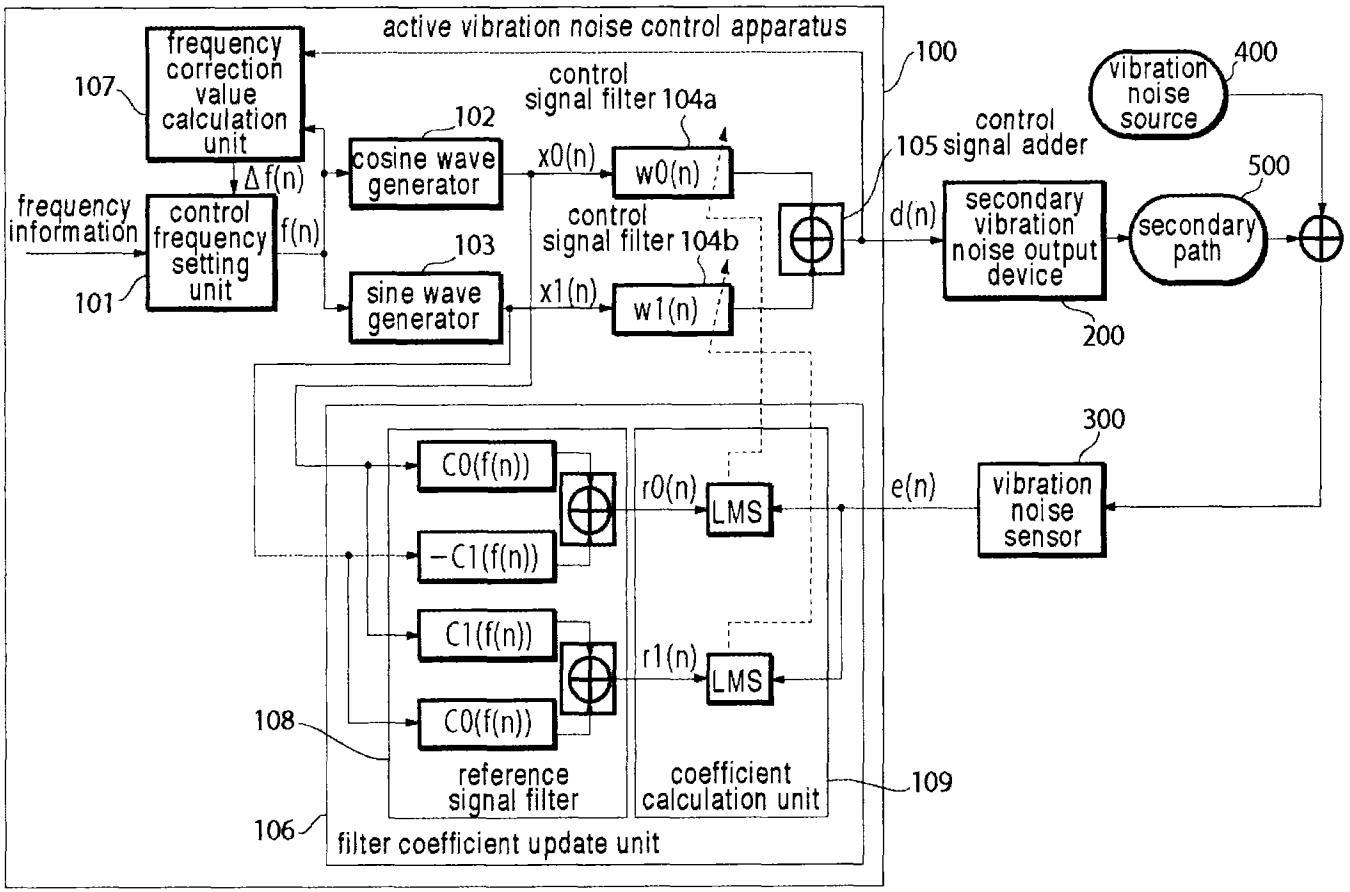
FIG. 1 is a block diagram of an active vibration noise control apparatus according to Embodiment 1 of the present invention.

As shown in FIG. 1, an active vibration noise control apparatus 100 according to Embodiment 1 of the present invention is connected to a secondary vibration noise output device 200 and a vibration noise sensor 300 that are disposed outside. The active vibration noise control apparatus 100 receives frequency information on vibration noise from a vibration noise source 400 being a controlled object, and outputs a generated control signal based on the input frequency information.

For example, in the case where the vibration noise source is an automobile engine, the frequency information of the vibration noise can be obtained by such a method in which a rotational frequency of an engine is measured on the basis of the period of ignition pulses, and then constant multiplication of the rotational frequency is performed in accordance with the rotational order of the engine generating the target vibration noise. And, in the case of a fan driven by an electric motor, the frequency of target NZ-noise can be obtained on the basis of the number of the motor poles, the frequency of a power supply, and the number of fan blades, etc. As described above, for obtaining frequency information of the vibration noise, means suitable for target vibration noise may be adopted.

A secondary vibration noise output device 200 converts the control signal input from the active vibration noise control apparatus 100 to a secondary vibration noise for canceling the vibration noise generated from the vibration noise source 400, and outputs the secondary vibration noise. The device is realized with, for example, a speaker or an actuator, etc.

The secondary vibration noise output from the secondary vibration noise output device 200 propagates through a secondary path 500, and interferes with the vibration noise generated from the vibration noise source 400, so that the vibration noise concerned is reduced. Here, the secondary path 500 is defined to be a path through which the second vibration noise output from the secondary vibration noise output device 200 transmits while propagating toward the vibration noise sensor 300.

The vibration noise sensor 300 detects an error which is residual vibration noise generated by the interference between the vibration noise and the secondary vibration noise, and outputs the detected error as an error signal to the active vibration noise control apparatus 100. The sensor is realized using, for example, a microphone, a vibration sensor, or an accelerometer, etc.

Next, a detailed configuration of the active vibration noise control apparatus 100 will be described. The active vibration noise control apparatus 100 includes a control frequency setting unit 101, a cosine wave generator 102, a sine wave generator 103, a control signal filter 104*a*, a control signal filter 104*b*, a control signal adder 105, a filter coefficient update unit 106, and a frequency correction value calculation unit 107. Here, the control signal filter 104*a* is a first control signal filter, and the control signal filter 104*b* is a second control signal filter.

The control frequency setting unit 101 sets a control frequency on the basis of frequency information input from the outside and a control frequency correction value input from the frequency correction value calculation unit 107.

The cosine wave generator 102 is a signal generator that generates a cosine wave signal corresponding to the control frequency set by the control frequency setting unit 101. The cosine wave generator 102 outputs a generated cosine wave signal to the control signal filter 104*a*. The sine wave generator 103 is a signal generator that generates a sine wave signal corresponding to the control frequency set by the control frequency setting unit 101. The sine wave generator 103 outputs a generated sine wave signal to the control signal filter 104*b*.

The control signal filter 104*a* applies filter processing to the cosine wave signal from the cosine wave generator 102. The control signal filter 1041) applies filter processing to the sine wave signal from the sine wave generator 103. The control signal adder 105 sums the outputs from the control signal filters 104*a* and 104*b* and outputs the control signal. The control signal is a signal that is to be converted into the secondary vibration noise for reducing the vibration noise, the detail of which will be described later.

The filter coefficient update unit 106 updates filter coefficients of the control signal filter 104*a* and the control signal filter 104*b* on the basis of the cosine wave signal output from the cosine wave generator 102, the sine wave signal output from the sine wave generator 103, and the error signal from the vibration noise sensor 300. The filter coefficient update unit 106, for example, can be configured with a reference signal filter 108 and a filter coefficient calculation unit 109 as shown in FIG. 1.

The reference signal filter 108 is a filter that synthesizes reference signals from the cosine wave signal of the cosine wave generator 102 and the sine wave signal of the sine wave generator 103, using a transfer characteristic parameter determined on the basis of a transfer characteristic of the secondary path 500. The filter coefficient calculation unit 109 updates the filter coefficients of the control signal filters 104*a* and 104*b* using an adaptive algorithm such as LMS (Least Mean Square) algorithm on the basis of the reference signals from the reference signal filter 108 and the error signal from the vibration noise sensor 300.

The frequency correction value calculation unit 107 outputs, to the control frequency setting unit 101, a frequency correction value for correcting a mismatch between the control frequency and the vibration noise frequency on the basis of the control frequency from the control frequency setting unit 101 and the control signal from the control signal adder 105.

Next, an operation of Embodiment 1 of the present invention will be described using FIG. 1.

First, frequency information representing a frequency of the vibration noise is input to the control frequency setting unit 101 within the active vibration noise control apparatus 100. The control frequency setting unit 101 determines the control frequency f(n) on the basis of this frequency information and a later-described frequency correction value Δf(n) from the frequency correction value calculation unit 107, and sets the control frequency f(n) to the cosine wave generator 102 and the sine wave generator 103. With the frequency F(n) indicated by the frequency information of the vibration noise and the frequency correction value Δf(n), the control frequency f(n), for example, is defined by Equation 1 below.

$$f(n)=F(n)+\Delta f(n) \qquad \text{Equation 1}$$

Here, n is a positive integer representing a sampling time in digital signal processing.

In the case where there is no mismatch between the frequency F(n) indicated by the frequency information and the control frequency or the device is just after the initiation of the operation, the frequency correction value Δf(n) equals to zero, and thus it may be possible that f(n) equals to F(n).

The cosine wave generator 102 outputs the cosine wave signal $x_0(n)$ of the control frequency f(n) to the control signal filter 104*a* and the filter coefficient update unit 106. The sine wave generator 103 outputs the sine wave signal $x_1(n)$ of the control frequency f(n) to the control signal filter 104*b* and the filter coefficient update unit 106.

The control signal filter 104*a* carries out a process in which the cosine wave signal $x_0(n)$ is multiplied by a filter coefficient $w_0(n)$ when the cosine wave signal $x_0(n)$ is input. Further, the control signal filter 104*b* carries out a process in which the sine wave signal $x_1(n)$ is multiplied by a filter coefficient $w_1(n)$ when the sine wave signal $x_1(n)$ is input. Furthermore, the control signal adder 105 carries out a summing process of the outputs of the control signal filter 104*a* and 104*b* to generate the control signal d(n), and then outputs the result to the secondary vibration noise output device 200. The control signal d(n) is expressed by Equation 2 below.

$$d(n)=w_0(n)\cdot x_0(n)+w_1(n)\cdot x_1(n) \quad \text{Equation 2}$$

The secondary vibration noise output device 200 converts the control signal d(n) output from the control signal adder 105 into the secondary vibration noise and outputs the secondary vibration noise. The secondary vibration noise output from the secondary vibration noise output device 200 propagates through the second path 500. The secondary vibration noise influenced by the transfer characteristic of the secondary path 500 interferes with the vibration noise generated from the vibration noise source 400, and then the vibration noise is reduced.

The vibration noise sensor 300 detects the reduced vibration noise, that is, the summing result of the vibration noise and the secondary vibration noise that corresponds to an error being residual vibration noise, and generates an error signal e(n). The error signal e(n) generated in the vibration noise sensor 300 is input to the filter coefficient update unit 106 within the active vibration noise control apparatus 100.

The filter coefficient update unit 106 updates the filter coefficients of the control signal filter 104*a* and 104*b* by the error signal e(n), the cosine wave signal $x_0(n)$, and the sine wave signal $x_1(n)$, for example, as shown in the following description.

The reference signal filter 108 in the filter coefficient update unit 106 generates reference signals $r_0(n)$ and $r_1(n)$ as shown in Equation 3 below on the basis of the transfer characteristic parameters $C_0(f(n))$ and $C_1(f(n))$ when the cosine wave signal $x_0(n)$ and the sine wave signal $x_1(n)$ are input.

$$r_0(n)=C_0(f(n))\cdot x_0(n)-C_1(f(n))\cdot x_1(n)$$

$$r_1(n)=C_1(f(n))\cdot x_0(n)-C_0(f(n))\cdot x_1(n) \quad \text{Equation 3}$$

Here, the transfer characteristic parameters $C_0(f(n))$ and $C_1(f(n))$ are parameters that are predetermined by a prescribed method on the basis of the transfer characteristic of the secondary path 500 at the control frequency f(n). That is, the reference signal filter 108 generates the reference signals $r_0(n)$ and $r_1(n)$ from signals $x_0(n)$ and $x_1(n)$ having the control frequency f(n) on the basis of the transfer characteristic of the secondary path from the secondary vibration noise output device 200 to the vibration noise sensor 300.

The filter coefficient calculation unit 109 sequentially updates values of the filter coefficient $w_0(n)$ of the control signal filter 104*a* and the filter coefficient $w_1(n)$ of the control signal filter 104*b* on the basis of the reference signals $r_0(n)$ and $r_1(n)$ from the reference signal filter 108 and the error signal e(n) from the vibration noise sensor 300, as shown in Equation 4 below.

$$w_0(n+1)=w_0(n)+\mu\cdot r0(n)\cdot e(n)$$

$$w_1(n+1)=w_1(n)+\mu\cdot r1(n)\cdot e(n) \quad \text{Equation 4}$$

Here, μ is an update step size for adjusting adaptation capability of the adaptive notch filter and is set by a prescribed method.

Further, the frequency correction value calculation unit 107 detects the frequency mismatch between the control frequency f(n) and the actual vibration noise frequency of the vibration noise source 400 on the basis of the control frequency f(n) from the control frequency setting unit 101 and the control signal d(n) from the control signal adder 105, and transmits a frequency correction value Δf(n+1) at the subsequent time n+1 to the control frequency setting unit 101. At the subsequent time n+1, the control frequency setting unit 101 sets the control frequency f(n+1) on the basis of the frequency information F(n+1) and the frequency correction value Δf(n+1) at the time n+1.

Here, the reason why the mismatch between the control frequency f(n) and the actual vibration noise frequency can be detected from the control signal d(n) and a method to determine the frequency correction value Δf(n+1) will be described in detail.

In the case where there is a mismatch between the control frequency f(n) and the actual vibration noise frequency, the phase relation between the secondary vibration noise output from the secondary vibration noise output device 200 and the vibration noise varies from hour to hour owing to the mismatch in the frequency. Even if a maximum vibration noise reduction effect can be obtained owing to the secondary vibration noise being at first completely in the opposite phase with respect to the vibration noise, the secondary vibration noise gradually deviates from being in the opposite phase by the change in the phase relation, and thus the reduction effect on the vibration noise is weakened.

Meanwhile, the filter coefficient update unit 106 updates the coefficients of the control signal filters 104*a* and 104*b* so as to minimize the error signal e(n) on the basis of the MSE (Mean Square Error) norm. Here, the control signal d(n) being a source signal for the secondary vibration noise can be rewritten by Equations 5 and 6 below using Equation 2 described before.

$$\begin{aligned} d(n) &= w_0(n)\cos(2\pi f(n)n/Fs) + \\ &\quad w_1(n)\sin(2\pi f(n)n/Fs) \\ &= A(n)\sin(2\pi f(n)n/Fs+\theta(n)) \end{aligned} \quad \text{Equation 5}$$

*Fs*: sampling frequency $$A(n)=\sqrt{(w_0(n))^2+(w_1(n))^2} \quad \text{Equation 6}$$

$$\theta(n)=\arctan\left(\frac{w_0(n)}{w_1(n)}\right)$$

In Equation 6, it is shown that the phase of the control signal d(n) is variable in accordance with $w_0(n)$ and $w_1(n)$. If the filter coefficient update unit 106 continues to update the filter coefficients $w_0(n)$ and $w_1(n)$ so as to minimize the error signal e(n), naturally the phase of the control signal d(n) being the source signal for the secondary vibration noise is continuously corrected so as for the secondary vibration noise to be kept in the opposite phase with respect to the vibration noise. As a result, the frequency of the control signal d(n) coincides with the vibration noise frequency, deviating from the control frequency f(n).

Figure 2:
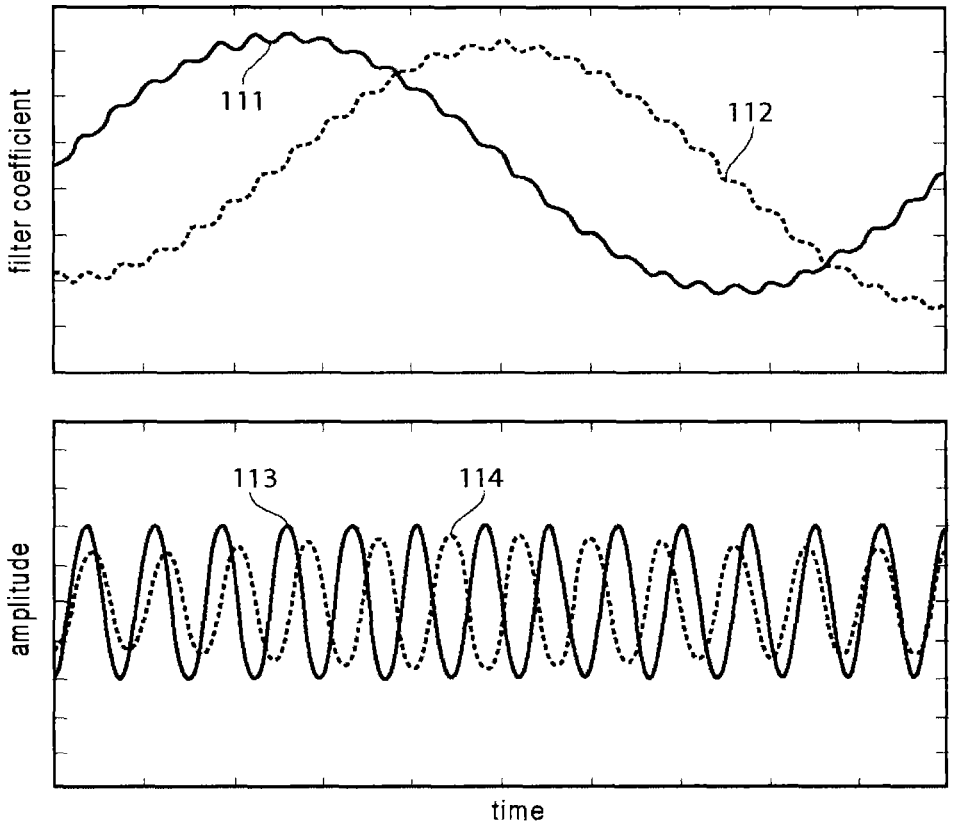
FIG. 2 is graphs in which temporal variations of filter coefficients, and temporal variations of a cosine wave signal and a control signal are comparatively and explanatorily shown in a case of the active vibration noise control apparatus without a correction for a control frequency.

FIG. 2 shows, as an example, temporal variations of the filter coefficients $w_0(n)$ (111 in the figure) and $w_1(n)$ (112 in the figure), and waveforms of the cosine wave signal $x_0(n)$ (113 in the figure) of the cosine wave generator 102 and the control signal d(n) (114 in the figure), in the case where the control frequency is higher than the actual vibration noise frequency in the active vibration noise control apparatus without a correction means for the control frequency. In this example, due to continuous variations in the filter coefficients $w_0(n)$ and $w_1(n)$, the frequency of the control signal d(n) is lower than the frequency of the cosine wave signal $x_0(n)$, i.e., the control frequency, so as to coincide with the actual vibration noise frequency.

Figure 3:
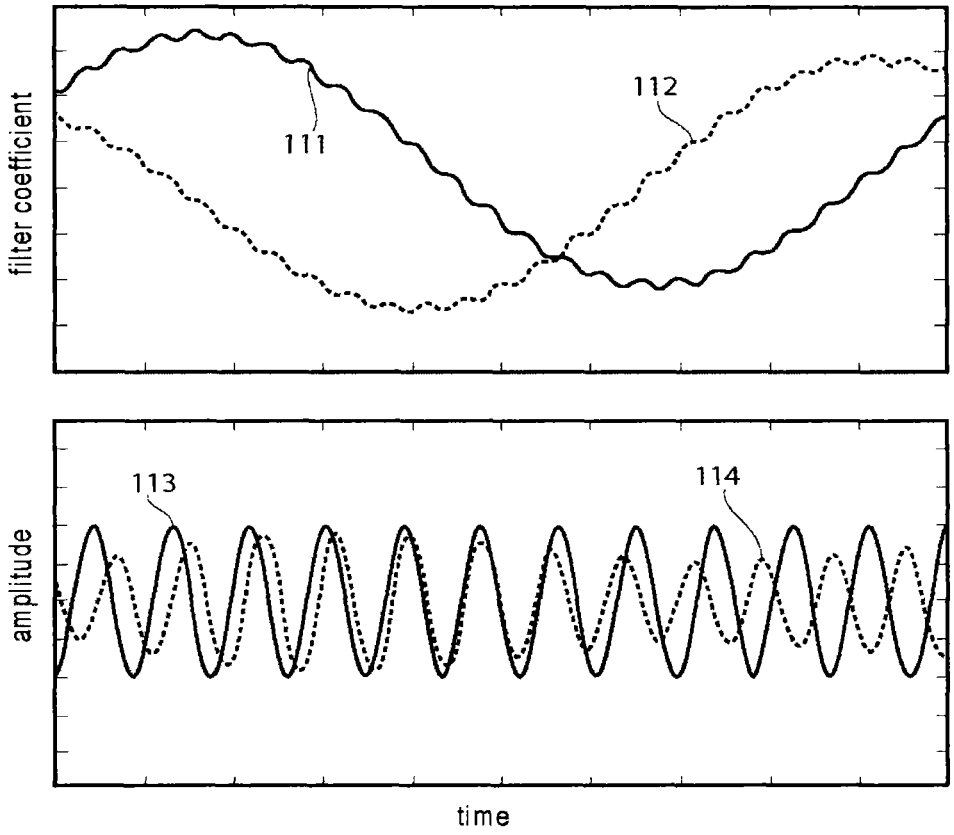
FIG. 3 is graphs in which temporal variations of filter coefficients, and temporal variations of a cosine wave signal and a control signal are comparatively and explanatory shown in a case of the active vibration noise control apparatus without a correction for a control frequency.

Further, FIG. 3 shows an example in which the control frequency is lower than the actual vibration noise frequency, and the same numeral as that in FIG. 2 is placed in each graphic line. In this case, the frequency of the control signal d(n) is higher than the frequency of the cosine wave signal $x_0(n)$.

Therefore, by checking the frequency of the control signal d(n), the actual vibration noise frequency can be specified, and further a necessary frequency correction value Δf(n+1) can be determined. In the frequency correction value calculation unit 107, the frequency f'(n) of the control signal d(n) is measured and the frequency correction value Δf(n+1) is determined from the difference between f'(n) and the control frequency f(n), as shown in Equation 7 below.

$$\Delta f(n+1)=f'(n)-f(n) \quad \text{Equation 7}$$

Since the control signal d(n) is a sine wave signal, the frequency f'(n) of which can be easily measured. For example, by measuring a cycle from the time interval between two points when the positive or the negative sign of the control signal d(n) is reversed, and by converting the cycle into a frequency, f'(n) can be obtained.

While there may be some errors and dispersion in the obtained f'(n) when the sampling frequency for the signal is not high enough, the frequency correction value can be obtained more accurately, for example, by averaging Δf(n+1) using Equation 8 below.

$$\Delta f(n+1)=\alpha\cdot\Delta f(n)+(1-\alpha)\cdot(f'(n)-f(n)) \quad \text{Equation 8}$$

Here, a is a prescribed constant that satisfies $0\leq\alpha\leq1$.

In the case where the frequency of the control signal is high, effective are methods of measuring the frequency from a time interval during which sign reversals occur predetermined times or from the number of zero crossings per unit time.

The computational processing carried out in the frequency correction value calculation unit 107 is so simple that the frequency mismatch can be corrected without largely burdening a processor.

Since the cosine wave signal $x_0(n)$, the sine wave signal $x_1(n)$, and the control signal d(n) are signals all generated inside the apparatus, they do not include any noise, so that the frequency correction value Δf(n+1) can be determined stably and accurately.

As described above, according to Embodiment 1 of the present invention, the control frequency is corrected by determining the frequency correction value on the basis of the control signal, so that the mismatch between the control frequency and the actual vibration noise frequency can be eliminated with simple computational processing.

Furthermore, since the cosine wave signal $x_0(n)$ and the sine wave signal $x_1(n)$ are generated inside, the cosine wave signal $x_0(n)$ and the sine wave signal $x_1(n)$ are not influenced by external disturbances such as noise, so that the mismatch between the control frequency and the actual vibration noise frequency can be accurately eliminated.

In addition, by averaging the frequency correction value, the frequency correction value can be obtained accurately even when the sampling frequency is not high enough.

Embodiment 2

The invention is applicable in a configuration in which the cosine wave signal $x_0(n)$ and the sine wave signal $x_1(n)$ that are sources for the control signal d(n) are not generated inside, but are input from the outside of an active vibration noise control apparatus. As an example of the configuration, an active vibration noise control apparatus according to Embodiment 2 of the present invention will be described.

Figure 4:
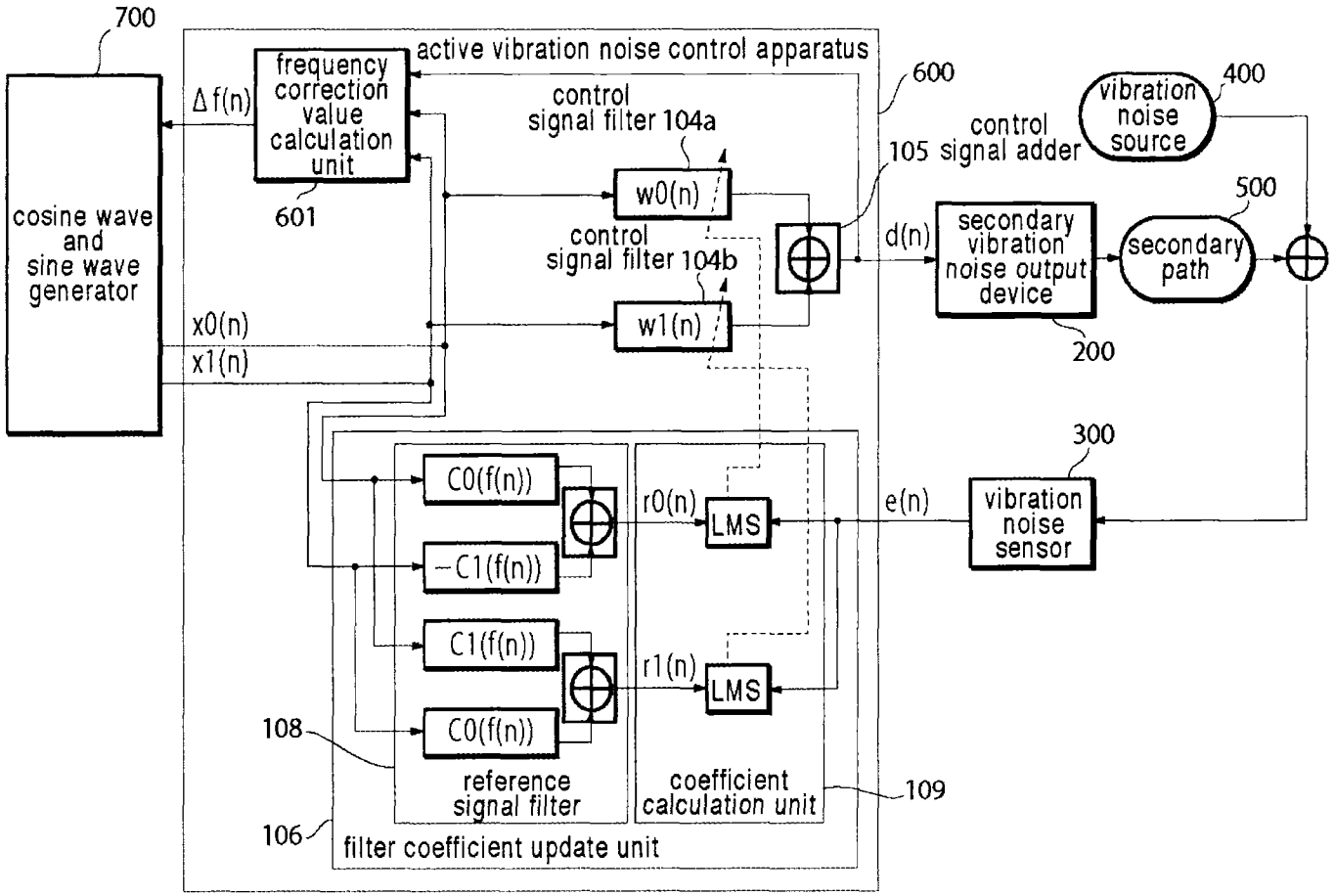
FIG. 4 is a block diagram of an active vibration noise control apparatus according to Embodiment 2 of the present invention.

In the following description, Embodiment 2 of the present invention will be described using figures. FIG. 4 is a block diagram of the active vibration noise control apparatus according to Embodiment 2 of the present invention. It is noted that parts common with or corresponding to those in Embodiment 1 are denoted by the same reference numerals as those in FIG. 1.

As shown in FIG. 4, the active vibration noise control apparatus 600 according to Embodiment 2 is connected to a cosine wave and sine wave generator 700 and the secondary vibration noise output device 200. In FIG. 4, numeral 601 is a frequency correction value calculation unit. In the active vibration noise control apparatus 600, the cosine wave signal $x_0(n)$ and the sine wave signal $x_1(n)$ corresponding to a vibration noise frequency input from the external cosine wave and sine wave generator 700 are transmitted to the control signal filters 104*a* and 104*b*, respectively, and these are summed in the control signal adder 105 to output the control signal d(n). The frequency correction value calculation unit 601 calculates the frequency correction value Δf(n) on the basis of the control signal d(n), and the cosine wave signal $x_0(n)$ or the sine wave signal $x_1(n)$ to output the result to the external cosine wave and sine wave generator 700.

As described in Embodiment 1, since the function of the filter coefficient update unit 106 is to bring the frequency of the control signal d(n) close to the actual vibration noise frequency, the frequency correction value calculation unit 601 measures the frequency f'(n) of the control signal d(n) and the frequency f(n) of the cosine wave signal $x_0(n)$ or the sine wave signal $x_1(n)$, and calculates the frequency correction value Δf(n) by subtracting f(n) from f'(n).

The frequencies of the control signal d(n) and the cosine wave signal $x_0(n)$ or the sine wave signal $x_1(n)$ can be calculated by measuring the cycle from the time interval between the two points when the positive or the negative sign of each signal is reversed, as described in Embodiment 1.

Otherwise, a temporal variation of the phase difference between signals each other is obtained from a variation in a time interval between a sign reversal timing of the control signal d(n) and a sign reversal timing of the cosine wave signal $x_0(n)$ or the sine wave signal $x_1(n)$, from which the frequency correction value may be determined. For example, a timing at which the phase of each signal passes through zero degree can be found by checking the timing at which the sign is reversed from negative to positive. Hence, if a time interval that is from a time at which the sign of the cosine wave signal $x_0(n)$ or the sine wave signal $x_1(n)$ is reversed from negative to positive until a time at which the sign of the control signal d(n) is reversed from negative to positive as well, is measured, the time interval between the time at which the phase of the former signal passes through zero and the time at which the phase of the latter signal passes through zero can be found. The temporal variation of the phase difference between both of the signals can be observed by carrying on the measurement, based on which the frequency correction value Δf(n) can be determined.

Figure 5:
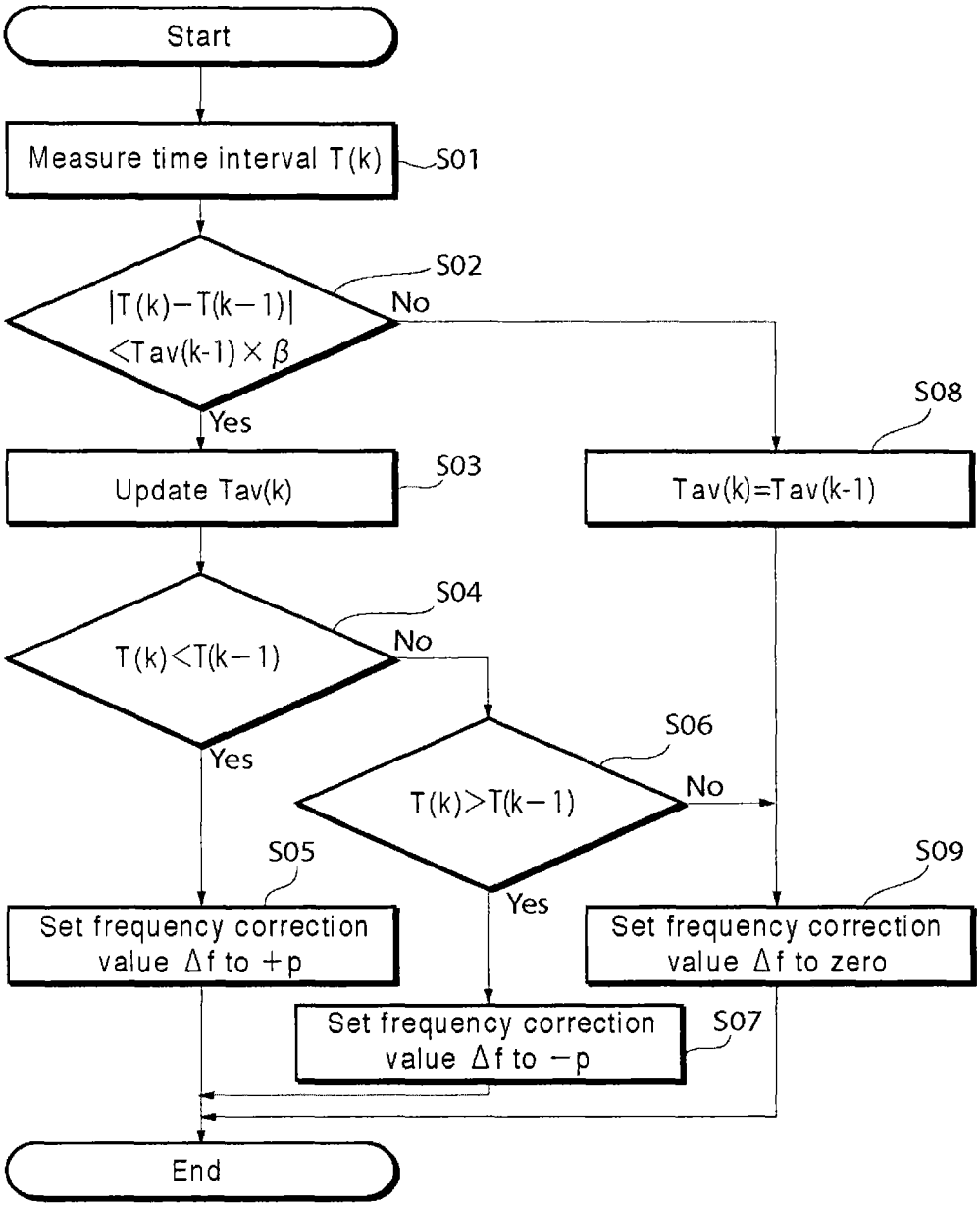
FIG. 5 is a flow chart for determining a frequency correction value of a control frequency from the control signal and the cosine wave signal or the sine wave signal, in a frequency correction value calculation unit of the active vibration noise control apparatus according to Embodiment 2 of the present invention.

Further, it may be possible that the frequency correction value Δf(n) is set to positive or negative fixed values of a prescribed absolute value. In the following description, a specific example of this procedure will be described using the flow chat of FIG. 5. First, in Step S01, a time interval T(k) that is from a time at which the sign of the cosine wave signal $x_0(n)$ is reversed from negative to positive until a time at which the sign of the control signal d(n) is reversed from negative to positive, is measured. Here, k denotes the number of measurement for the time intervals. Note that, in this example, although the cosine wave signal $x_0(n)$ is used, the sine wave signal $x_1(n)$ may be used instead.

In Step S02, it is determined whether Equation 9 below is satisfied or not.

$$|T(k)-T(k-1)|<T(k-1)\cdot\beta \quad \text{Equation 9}$$

Equation 9 is a conditional expression as to whether or not the magnitude of the change in time interval is equal to or larger than a value obtained by multiplying the average value so far by a prescribed constant. $T_{av}(k-1)$ is a moving average value of the magnitude of the change in time interval t(k) and β is a prescribed constant. If the control signal d(n) delays by one cycle or more with respect to the cosine wave signal $x_0(n)$ and vice versa, |T(k)−T(k−1)| temporarily becomes large, and thus the frequency correction value Δf(n) cannot be determined accurately. The purpose of Step S02 is to detect this condition. The processing is shifted to Step S03 if Equation 9 is satisfied and the processing is shifted to Step S08 if Equation 9 is not satisfied.

In Step S03, $T_{av}(k)$ is updated by Equation 10 below.

$$T_{av}(k)=T_{av}(k-1)\cdot\gamma+|T(k)-T(k-1)|\cdot(1-\gamma) \quad \text{Equation 10}$$

Here, γ is a constant that satisfies 0<γ<1.

In Step S04, it is determined whether T(k)<T(k−1) is satisfied or not. If satisfied, the phase difference of the control signal d(n) with respect to the cosine wave signal $x_0(n)$ is considered to be gradually decreased, and thus it is determined that the frequency of the cosine wave signal $x_0(n)$ is lower than the frequency of the control signal d(n), and the processing is shifted to Step S05. If not satisfied, the processing is shifted to Step S06.

In Step S05, the frequency correction value Δf(n+1)=p is set, and the processing is terminated. Here, p is a prescribed constant value and p>0.

In Step S06, it is determined whether T(k)>T(k−1) is satisfied or not. If the condition is satisfied, the phase difference of the control signal d(n) with respect to the cosine wave signal $x_0(n)$ is considered to be gradually increased, and thus it is determined that the frequency of the cosine wave signal $x_0(n)$ is larger than the frequency of the control signal d(n), and the processing is shifted to Step S07. If the condition is not satisfied, the processing is shifted to Step S09.

In Step S07, the frequency correction value Δf(n+1)=−p is set, and the processing is terminated.

In Step S09, since T(k)=T(k−1) is confirmed from the results of Step S04 and Step S06, and thus it is determined that the phase difference between the cosine wave signal $x_0(n)$ and the control signal d(n) is not changed and that the both signals have the same frequency, Δf(n+1)=0 is set and the processing is terminated.

Further, since |T(k)−T(k−1)| temporarily becoming large due to the signal phase delay of more than one cycle is detected in Step S02, $T_{av}(k)$ is not updated and $T_{av}(k)=T_{av}(k-1)$ is set in Step S08. In this case, since an accurate frequency correction value Δf(n) cannot be obtained, the processing is shifted to Step S09 and the frequency correction value Δf(n+1)=0 is set, and then the processing is terminated.

As described above, the cosine wave and sine wave generator 700 corrects the frequencies of the cosine wave signal $x_0(n)$ and the sine wave signal $x_1(n)$ in accordance with the frequency correction value Δf(n) output from the active vibration noise control apparatus 600, so that the frequency mismatch between these signals and the actual vibration noise is gradually decreased and falls within ±p.

The above-mentioned computational processing is configured with simple arithmetic operations, sign checks of the signals, and conditional branching, so that the processing is quite simple and can be carried out without burdening a processor.

As described above, according to the active vibration noise control apparatus of Embodiment 2 of the present invention, even with the configuration in which the cosine wave signal and the sine wave signal are not generated inside, but are input from the outside of the apparatus, the frequency correction value is determined from the control signal and the cosine wave signal or the sine wave signal, and is output to the external sine wave and cosine wave signal generator, so that the frequency mismatch can be corrected. Excluding the sine wave and cosine wave signal generator from the active vibration noise control apparatus is effective in the case where downsizing of the active vibration noise control apparatus and reduction in the processor processing are required.

Furthermore, the computational processing for the frequency correction value is configured with sign checks of the signals, simple arithmetic operations, and conditional branching, and thus the frequency correction value can be obtained with the simple configuration.

In addition, the magnitude of the frequency correction value is set to the prescribed constant value, so that the frequency mismatch can be controlled within the range of the constant value.

Note that, it is apparent and a matter of course that the frequency correction value calculation unit in Embodiment 2 is not only applicable in the case where the cosine wave and sine wave generator is not included in the active vibration noise control apparatus, but applicable as well in the case where the cosine wave and sine wave generator is included in the active vibration noise control apparatus.

EXPLANATION OF REFERENCE CHARACTERS

100 active vibration noise control apparatus
101 control frequency setting unit
102 cosine wave generator
103 sine wave generator
104*a*, 104*b* control signal filter
105 control signal adder
106 filter coefficient update unit
107 frequency correction value calculation unit
108 reference signal filter
109 filter coefficient calculation unit
111 filter coefficient $w_0(n)$
112 filter coefficient $w_1(n)$
113 cosine wave signal $x_0(n)$
114 control signal d(n)
200 secondary vibration noise output device
300 vibration noise sensor
400 vibration noise source
500 secondary path
600 active vibration noise control apparatus
601 frequency correction value calculation unit
700 cosine wave and sine wave generator

The invention claimed is:

1. An active vibration noise control apparatus comprising:

a first control signal filter to which a cosine wave signal oscillating at a control frequency specified in accordance with a vibration noise source is input, the vibration noise source generating a vibration noise;

a second control signal filter to which a sine wave signal oscillating at the control frequency is input;

a control signal adder configured to output a control signal generated by adding an output of the first control signal filter and an output of the second control signal filter;

a filter coefficient updater configured to update coefficients of the first control signal filter and the second control signal filter on the basis of an error signal, the cosine wave signal, and the sine wave signal, the error signal being obtained from an interference result of the vibration noise with a secondary vibration noise generated on the basis of the control signal; and a frequency correction value calculator configured to calculate a frequency correction value used for adjusting the control frequency based on measuring a mismatch between a frequency of the control signal and the control frequency.

2. The active vibration noise control apparatus according to claim 1, further comprising a cosine wave generator for generating the cosine wave signal oscillating at the control frequency and a sine wave generator for generating the sine wave signal oscillating at the control frequency.

3. The active vibration noise control apparatus according to claim 2, wherein the frequency correction value calculator calculates the frequency correction value on the basis of a difference between a measured frequency obtained from the control signal and the control frequency.

4. The active vibration noise control apparatus according to claim 3, wherein the frequency correction value calculator calculates the frequency correction value by calculating an average of frequency correction values in the past.

5. The active vibration noise control apparatus according to claim 3, wherein the frequency correction value calculator outputs a positive prescribed frequency correction value in a case where the frequency of the control signal is larger than the control frequency, outputs a negative prescribed frequency correction value in a case where the frequency of the control signal is smaller than the control frequency, and thus makes a mismatch between the frequency of the vibration noise and the control frequency converge into a range determined by the prescribed frequency correction values.

6. The active vibration noise control apparatus according to claim 2, wherein the frequency correction value calculator calculates the frequency correction value on the basis of a difference between a measured frequency obtained from the control signal, and a frequency of the cosine wave signal or the sine wave signal.

7. The active vibration noise control apparatus according to claim 2, wherein the frequency correction value calculator calculates a frequency difference on the basis of a temporal variation of a phase difference between the control signal, and the cosine wave signal or the sine wave signal.

8. The active vibration noise control apparatus according to claim 7, wherein the frequency correction value calculator detects the temporal variation of the phase difference on the basis of a variation in a time interval between a time at which the sign of the control signal is reversed and a time at which the sign of the cosine wave signal or the sine wave signal is reversed.

9. The active vibration noise control apparatus according to claim 2, wherein the frequency correction value calculator calculates the frequency correction value by calculating an average of frequency correction values in the past.

10. The active vibration noise control apparatus according to claim 2, wherein the frequency correction value calculator outputs a positive prescribed frequency correction value in a case where the frequency of the control signal is larger than the control frequency, outputs a negative prescribed frequency correction value in a case where the frequency of the control signal is smaller than the control frequency, and thus makes a mismatch between the frequency of the vibration noise and the control frequency converge into a range determined by the prescribed frequency correction values.

11. The active vibration noise control apparatus according to claim 1, wherein the frequency correction value calculator calculates the frequency correction value on the basis of a difference between a measured frequency obtained from the control signal and the control frequency.

12. The active vibration noise control apparatus according to claim 11, wherein the frequency correction value calculator calculates the frequency correction value by calculating an average of frequency correction values in the past.

13. The active vibration noise control apparatus according to claim 11, wherein the frequency correction value calculator outputs a positive prescribed frequency correction value in a case where the frequency of the control signal is larger than the control frequency, outputs a negative prescribed frequency correction value in a case where the frequency of the control signal is smaller than the control frequency, and thus makes a mismatch between the frequency of the vibration noise and the control frequency converge into a range determined by the prescribed frequency correction values.

14. The active vibration noise control apparatus according to claim 1, wherein the frequency correction value calculator calculates the frequency correction value on the basis of a difference between a measured frequency obtained from the control signal, and a frequency of the cosine wave signal or the sine wave signal.

15. The active vibration noise control apparatus according to claim 1, wherein the frequency correction value calculator calculates the frequency correction value by calculating an average of frequency correction values in the past.

16. The active vibration noise control apparatus according to claim 1, wherein the frequency correction value calculator outputs a positive prescribed frequency correction value in a case where the frequency of the control signal is larger than the control frequency, outputs a negative prescribed frequency correction value in a case where the frequency of the control signal is smaller than the control frequency, and thus makes a mismatch between the frequency of the vibration noise and the control frequency converge into a range determined by the prescribed frequency correction values.

17. An active vibration noise control apparatus comprising:

a first control signal filter to which a cosine wave signal oscillating at a control frequency specified in accordance with a vibration noise source is input, the vibration noise source generating a vibration noise;

a second control signal filter to which a sine wave signal oscillating at the control frequency is input;

a control signal adder outputting a control signal generated by adding an output of the first control signal filter and an output of the second control signal filter;

a filter coefficient updater updating coefficients of the first control signal filter and the second control signal filter on the basis of an error signal, the cosine wave signal, and the sine wave signal, the error signal being obtained from an interference result of the vibration noise with a secondary vibration noise generated on the basis of the control signal; and a frequency correction value calculator calculating a frequency correction value used for correcting a mismatch between a frequency of the vibration noise and the control frequency on the basis of the control signal, wherein the frequency correction value calculator calculates a frequency difference on the basis of a temporal variation of a phase difference between the control signal, and the cosine wave signal or the sine wave signal.

18. The active vibration noise control apparatus according to claim 17, wherein the frequency correction value calculator detects the temporal variation of the phase difference on the basis of a variation in a time interval between a time at which the sign of the control signal is reversed and a time at which the sign of the cosine wave signal or the sine wave signal is reversed.

* * * * *